US010065289B2

(12) United States Patent
Chinnakaruppan et al.

(10) Patent No.: US 10,065,289 B2
(45) Date of Patent: Sep. 4, 2018

(54) POLISHING FEATURES FORMED IN COMPONENTS

(71) Applicant: Apple Inc., Cupertino, CA (US)

(72) Inventors: Palaniappan Chinnakaruppan, Cupertino, CA (US); Srikanth Kamireddi, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 332 days.

(21) Appl. No.: 14/842,962

(22) Filed: Sep. 2, 2015

(65) Prior Publication Data

US 2016/0059383 A1 Mar. 3, 2016

Related U.S. Application Data

(60) Provisional application No. 62/044,862, filed on Sep. 2, 2014.

(51) Int. Cl.

| | |
|---|---|
| ***B24C 1/08*** | (2006.01) |
| ***B24C 3/32*** | (2006.01) |
| ***B24B 31/116*** | (2006.01) |

(52) U.S. Cl.

CPC ..... *B24C 1/08* (2013.01); *B24B 31/116* (2013.01); *B24C 1/083* (2013.01); *B24C 3/32* (2013.01); *B24C 3/327* (2013.01)

(58) Field of Classification Search

CPC .. B24C 1/08; B24C 1/083; B24C 3/32; B24C 3/327; B24B 31/116

USPC ..... 451/36, 76

See application file for complete search history.

(56) References Cited

U.S. PATENT DOCUMENTS

| | | | | |
|---|---|---|---|---|
| 3,039,234 | A * | 6/1962 | Balman | B24B 31/116 451/101 |
| 3,634,973 | A * | 1/1972 | McCarty | B24B 31/116 451/36 |
| 5,070,652 | A * | 12/1991 | Rhoades | B24B 31/116 451/104 |
| 5,746,691 | A * | 5/1998 | Frantzen | A61F 2/91 600/36 |
| 6,086,455 | A * | 7/2000 | Frantzen | A61F 2/91 451/36 |
| 6,276,993 | B1 * | 8/2001 | Miller | B24C 1/045 451/101 |
| 6,306,011 | B1 * | 10/2001 | Perry | B23Q 39/044 451/36 |

(Continued)

*Primary Examiner* — Eileen Morgan
(74) *Attorney, Agent, or Firm* — Dickinson Wright RLLP

(57) ABSTRACT

A polishing system and method for polishing a channel formed within a component is disclosed. The polishing system may include a tooling element operable to be positioned within a recess formed partially through a component. The tooling element may include an outer surface having a geometry corresponding to a geometry of the recess formed in the component. The tooling element forms a channel between the recess of the component and the tooling element when positioned in the recess. The system may also include a first member in fluid communication with a first opening of the channel, and a second member in fluid communication with a second opening of the channel. The second opening may be in fluid communication with the first opening via the channel. Additionally, the first and second member may be configured to continuously vary a pressure within the channel to move an abrasive slurry within the channel.

7 Claims, 16 Drawing Sheets

(56) References Cited

U.S. PATENT DOCUMENTS

| | | | | |
|---|---|---|---|---|
| 6,736,706 | B1 * | 5/2004 | Pan | B24C 3/327 451/36 |
| 6,739,956 | B2 * | 5/2004 | Noestheden | B22D 29/006 451/39 |
| 6,780,089 | B2 * | 8/2004 | Pan | B24B 31/006 451/113 |
| 9,227,300 | B2 * | 1/2016 | Yajima | B24C 1/10 |
| 9,669,516 | B2 * | 6/2017 | Lee | B24B 53/017 |
| 9,764,447 | B2 * | 9/2017 | Beckman | B24B 19/14 |
| 2004/0106359 | A1 * | 6/2004 | Pan | B24B 31/006 451/36 |

* cited by examiner

POLISHING FEATURES FORMED IN COMPONENTS

CROSS-REFERENCE TO RELATED APPLICATIONS

This application is a nonprovisional patent application of and claims the benefit to U.S. Provisional Patent Application No. 62/044,862, filed Sep. 2, 2014 and titled "POLISHING CHANNELS FORMED WITHIN COMPONENTS," the disclosure of which is hereby incorporated herein by reference in its entirety.

FIELD

The disclosure relates generally to material polishing, and more particularly to a method and polishing system for polishing a feature (e.g., channels, recesses) formed within a component formed from substantially hard material.

BACKGROUND

Electronic devices continue to become more prevalent in day-to-day activities. For example, smart phones, tablet computers and electronic devices continue to grow in popularity and provide everyday personal and business functions to its users. These electronic devices may include housings to protect the internal components of the device. Additionally, the electronic device typical includes a cover glass for protecting a display of the device. The display may be utilized by the user to interact (e.g., through input/output operations) with the electronic device and/or receive information therefrom.

The use of ceramic-based materials, and specifically, the crystalline form of alumina (Al2O3) (e.g., corundum), commonly known as sapphire, may be used to form the housing and/or cover glass of the electronic device. With improved manufacturing processes of single crystal sapphire and the improved functional characteristics (such as hardness and strength) of sapphire, sapphire may be an acceptable replacement material for conventional housings or cover glass. However, the same chemical/elemental characteristics that make sapphire an often superior material choice over glass may also make the manufacturing of sapphire difficult. That is, due to sapphire's hardness, processing or shaping sapphire may be difficult.

For example, where the sapphire display includes curved or non-planar surfaces, conventional polishing techniques and processes may fall short of providing an adequate or desired polish on the curved or non-planar surfaces of the sapphire. Furthermore, small channels (e.g., recesses, through holes, and the like) formed through the sapphire component may be difficult to adequately polish using conventional polishing processes. Where the sapphire component is substantially thin to help reduce the overall size and weight of the electronic device, a conventional polishing process, such as diamond mechanical polishing (DMP), may also be too harsh on the sapphire component, and may potentially damage the sapphire.

SUMMARY

One embodiment described herein takes the form of a polishing system comprising: a tooling element operable to be positioned at least partly within a recess of a component and comprising an outer surface having a geometry corresponding to a geometry of the recess, the tooling element defining a channel within the recess; a first member in fluid communication with a first opening of the channel; and a second member in fluid communication with a second opening of the channel; wherein the second opening is in fluid communication with the first opening via the channel; and the first member and the second member are configured to continuously vary a pressure within the channel to move an abrasive slurry positioned within at least a portion of the channel.

Another embodiment takes the form of a structure comprising: a corundum-based component comprising: a body portion; and a recess formed partially though the body portion, the recess having a complex geometry; and a tooling element operable to be positioned within the recess, thereby defining, between the tooling element and the body portion, a channel within the recess; wherein the tooling element comprises an outer surface having a geometry corresponding to the complex geometry of the recess.

Still another embodiment described herein may take the form of a component having body portion and a first opening formed on the body portion. The component may also comprise a second opening formed on the body portion. The second opening may be in fluid communication with the first opening. The component may also comprise a uniformly polished channel fluidly coupling the first opening and the second opening. The uniformly polished channel may have a complex geometry, such as a curved portion, an angular portion and/or a non-linear portion.

Yet another embodiment takes the form of a method for polishing a surface of a channel formed in a component, comprising the operations of: forming a channel between a recess formed partially through a component and a tooling element positioned within the recess of the component, the tooling element comprising an outer surface having a geometry corresponding to a geometry of the recess; coupling a first member and a second member of a polishing system to at least one of the component and the tooling element to enable fluid communication with the channel; and flowing an abrasive slurry positioned within the channel over a surface of the recess between the first member and the second member, thereby polishing the surface.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates to a material polishing, and more particularly, to a method and polishing system for polishing a feature (e.g., channel, recess, or the like) formed within a component formed from substantially hard material.

In a particular embodiment, the polishing system may utilize an abrasive slurry positioned within a channel formed through the component and two distinct polishing components positioned on opposite sides of the channel. The two distinct polishing components may form a seal around the openings of the channel and may continuously vary a pressure within the channel to flow or otherwise move the abrasive slurry throughout the channel. As the abrasive slurry moves through the channel, it may contact and subsequently polish a sidewall or surface of the channel formed in the component.

In other embodiments, the component includes a recess in place of a through hole. In some embodiments, a channel may be formed between a surface of the recess and an exterior of a tooling element that may include or take the form of a corresponding geometry of the recess. The tooling element may be positioned within the recess formed in the component and may be positioned adjacent to the surface of the component to be polished. The tooling element includes a temporary and/or disposable insert or fill component that is positioned within the recess to form the channel between the component and the tooling element. The two distinct polishing components of the polishing system may be positioned on opposite openings of the channel formed between the recess and the tooling element, and may move or flow the abrasive slurry through the channel to polish the surface of the recess formed in the component.

These and other embodiments are discussed below with reference to FIGS. 1-10. However, those skilled in the art will readily appreciate that the detailed description given herein with respect to these Figures is for explanatory purposes only and should not be construed as limiting.

Figure 1:
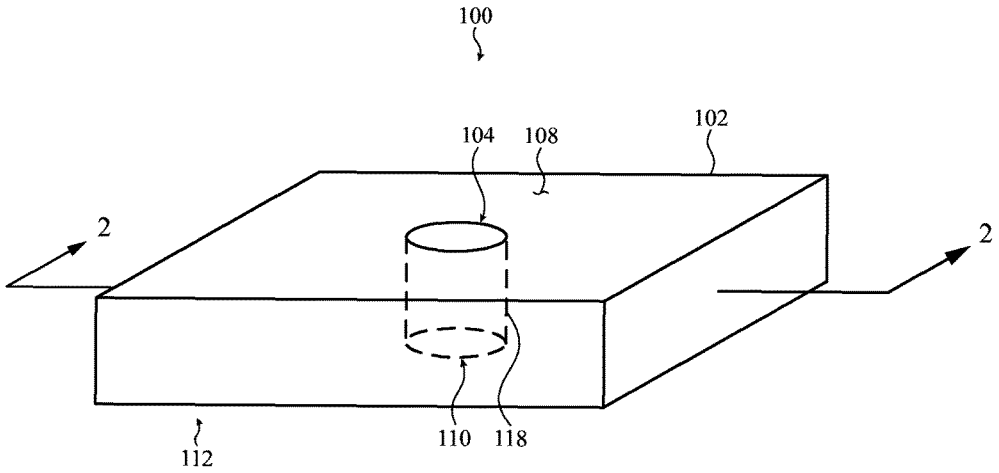
FIG. 1 depicts an illustrative view of a component having a channel, according to embodiments.

FIG. 1 is an illustrative view of a component 100. That is, FIG. 1 depicts a body portion 102 of a component 100 that may be utilized within or as part of an electronic device. In non-limiting examples, component 100 may be utilized to form a housing of the electronic device or a cover glass used to protect a display of the electronic device. The electronic device may include, but is not limited to, a tablet computing device, a smartphone, a gaming device, a display, a digital music player, a wearable computing device or display, a health monitoring device and so on.

Component 100 may be transparent or translucent, fully or partially, in certain embodiments. Component 100 may be formed from corundum, commonly referred to as sapphire. However, it is understood that component 100 may be formed from any suitable transparent material and/or combination of suitable transparent material including, but not limited to, ceramics, alumina, chemically strengthened glass and reinforced plastic.

As shown in FIG. 1, component 100 may include a feature, such as a component channel 104. In a non-limiting example, channel 104 may be formed completely through body portion 102 of component 100. That is, as shown in FIG. 1, a first opening 106 may be formed on a first or top surface 108 of body portion 102 and a second opening 110 may be formed on second or bottom surface 112 of body portion 102 of component 100. First opening 106 and second opening 110 may be in fluid communication with one another via channel 104 formed through body portion 102.

Channel 104 of component 100 may have a polished sidewall or component surface 118 when finished, incorporated into an electronic device, in an intermediate stage, and so on. The component surface 118 of channel 104 formed in component 100 may be polished for a variety of reasons including, but not limited to, aesthetics to smooth surface 118 for improved coupling to a distinct component within channel 104, to minimize a frictional coefficient of surface 118 of channel 104 and the like. However, because of a reduced thickness of component 100 and/or component's 100 material composition, which may be susceptible to damage when undergoing a conventional polishing processes (e.g., sand blasting, water blasting and the like), channel 104 may be polished using a less oppressive process, as discussed herein.

Figure 2:
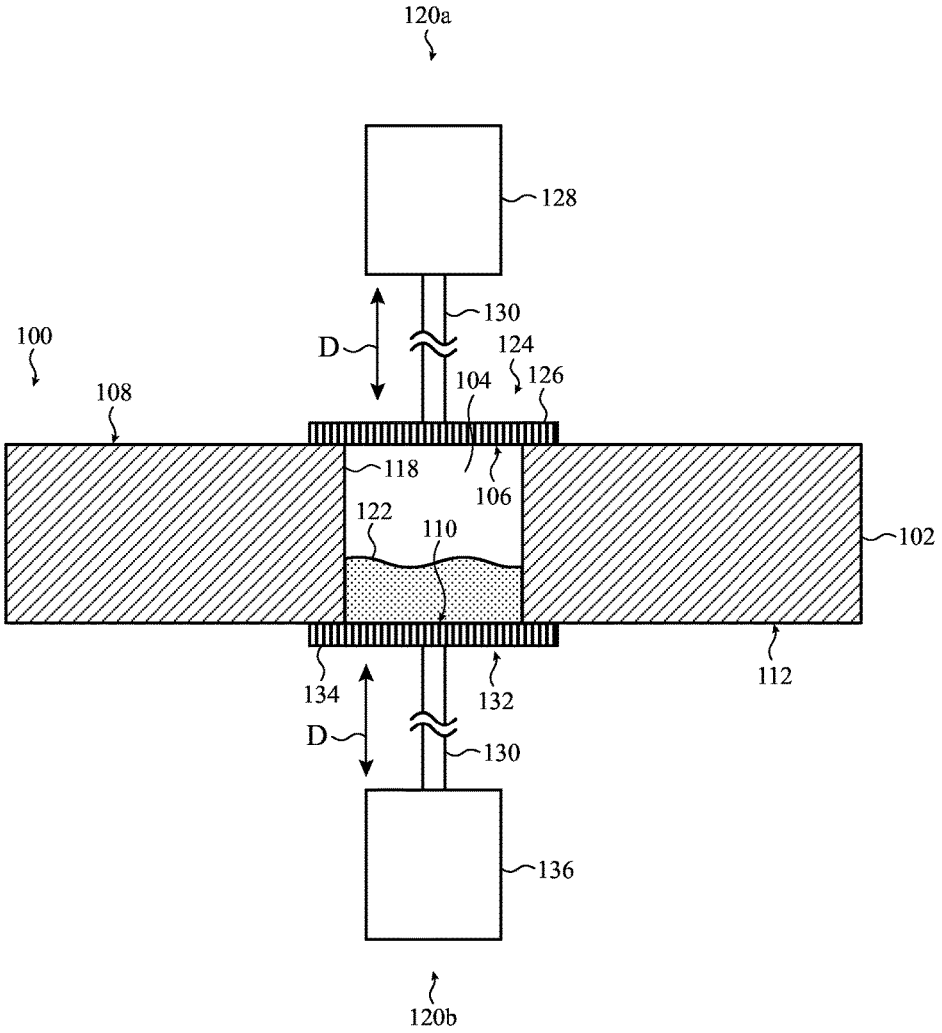
FIG. 2 depicts a cross-section view, taken along line 2-2, of the component of FIG. 1 and a polishing system.

FIG. 2 depicts a front cross-section view of component 100 taken along line 2-2 in FIG. 1. As shown in FIG. 2, a polishing system 120*a*, 120*b* may be coupled to component 100 and may be used to polish component surface 118 of channel 104. In a non-limiting example, and as discussed in detail herein, a two-part polishing system 120*a*, 120*b* may be in fluid communication with channel 104 via first opening 106 and second opening 110. In the non-limiting example and as discussed herein, polishing system 120*a*, 120*b* may be configured to move an abrasive slurry 122 positioned within a portion of channel 104 to polish component surface 118 of channel 104.

As shown in FIG. 2, polishing system 120*a* may include a first member 124 positioned adjacent to first opening 106 of channel 104. First member 124 may substantially cover first opening 106 of channel 104 and may be releasably coupled to a portion of top surface 108 of body portion 102 of component 100. First member 124 may be coupled to a portion of top surface 108 using any suitable technique including, but not limited to applying an adhesive, forming a suction bond between top surface 108 and first member 124 and the like. As shown in FIG. 2, first member 124 of polishing system 120*a* may include a first flexible membrane 126 that may form an airtight and/or hermetic seal around first opening 106 of channel 104. First flexible membrane 126 may be formed from a substantially flexible material that may allow first flexible membrane 126 to maintain the seal over first opening 106 and be actuated or deformed to change a pressure within channel 104, as discussed herein.

Polishing system 120*a* may also include a first actuator 128 coupled to first flexible membrane 126. As shown in FIG. 2, first actuator 128 may be coupled to first flexible membrane via shaft 130. First actuator 128 may be coupled to first flexible membrane 126 to actuate or deform a portion of first flexible membrane 126 to change or vary a pressure within channel 104 during a polishing process, as discussed herein. First actuator 128, as shown in FIG. 2, may be any suitable actuator that may actuate or deform first flexible membrane 126 in a direction (D) when performing a polishing process on channel 104 of component 100.

As shown in FIG. 2, two-part polishing system 120*a*, 120*b* may include components positioned on the opposite end (e.g., second opening 110) of channel 104. The components of polishing system 120*b* positioned on the opposite end or second opening 110 of channel 104 may be substantially similar to the components of polishing system 120*a* positioned adjacent to first opening 106 of channel 104. In a non-limiting example shown in FIG. 2, polishing system 120*b* may include a second member 132 positioned adjacent to second opening 110 of channel 104. Second member 132 may include a second flexible membrane 134 that may form a seal around second opening 110 of channel 104 and may be releasably coupled to a portion of bottom surface 112 of component 100. Second flexible membrane 134 may be formed from a substantially similar material as first flexible membrane 126 having substantially flexible properties.

Polishing system 120*b* may also include a second actuator 136 coupled to second flexible membrane 134. Second actuator 136 may be coupled to second flexible membrane 134 using shaft 130. Similar to first actuator 128, second actuator 136 may be coupled to second flexible membrane 134 to actuate or deform a portion of second flexible membrane 134 in a direction (D) to change or vary a pressure within channel 104 during a polishing process, as discussed herein.

Polishing system 120*a*, 120*b* may also include abrasive slurry 122. As shown in FIG. 2, abrasive slurry 122 may be positioned within channel 104 of component 100. In a non-limiting example, abrasive slurry 122 may fill a portion of channel 104 and may be sealed within channel 104 between first flexible membrane 126 and second flexible membrane 134 of polishing system 120*a*, 120*b*. As discussed herein, abrasive slurry 122 may not completely fill channel 104 of component 100 in order for abrasive slurry 122 to flow over and polish component surface 118 during a polishing process. Abrasive slurry 122 may include a diamond encrusted resin-based material that may have elastic properties to avoid damaging the surface of the sapphire material when performing the polishing process. The elastic properties of abrasive slurry 122 may avoid damaging component 100 by substantially deforming when flowing along and/or contacting component surface 118 of channel 104 during the polishing process. Additionally, the elastic properties of abrasive slurry 122 may aid in achieving complete coverage of surface 118 of channel 104 with abrasive slurry 122 during the polishing process.

Although discussed herein as a slurry, it is understood that other distinct materials or media may be used in the polishing processed discussed herein. In non-limiting examples, the slurry may be formed from any suitable material having substantially elastic properties, such as an elastomer material. In other non-limiting examples, polishing system 120*a*, 120*b* may utilize an oil, a clay, a gelatin and so on for polishing channel 104 of component 100. In the non-limiting examples, the material may be diamond encrusted and/or may include additional additives for providing abrasive properties to the material used to polish component 100.

Figure 3A:
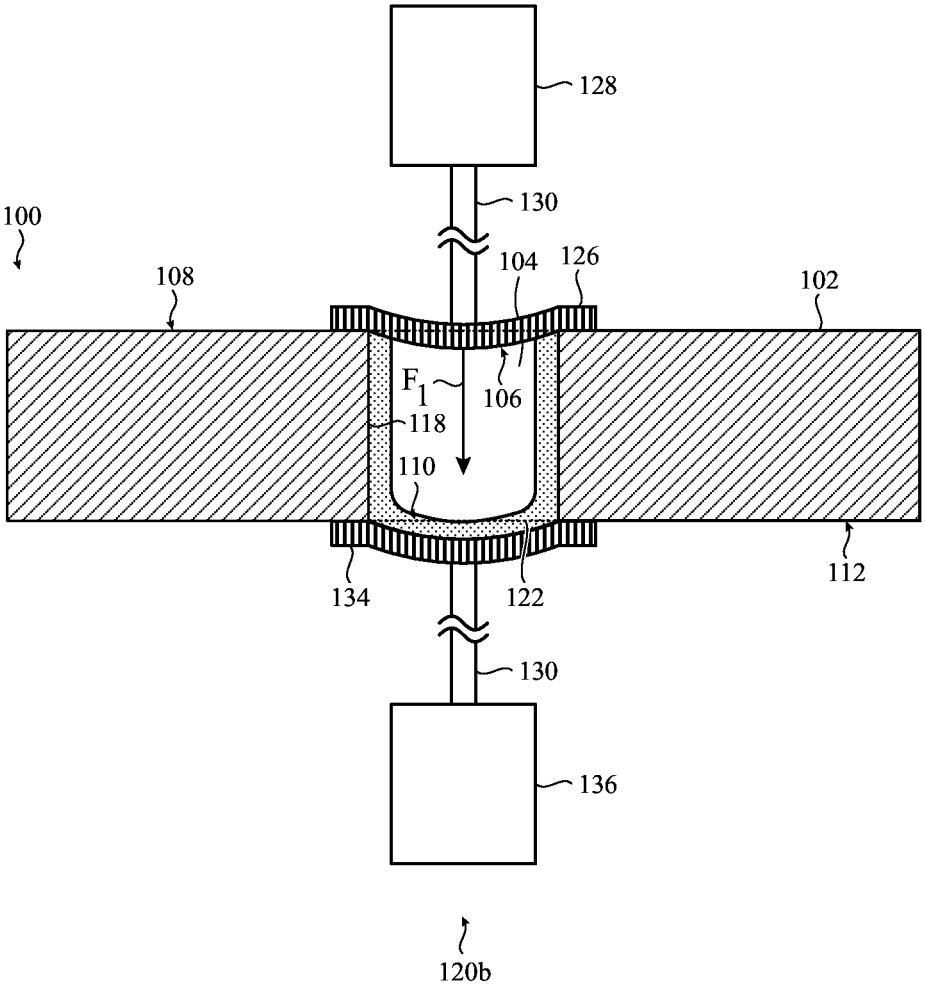
FIGS. 3A and 3B depict cross-section views of the component of FIG. 2 undergoing a polishing process performed by the polishing system.
Figure 3B:
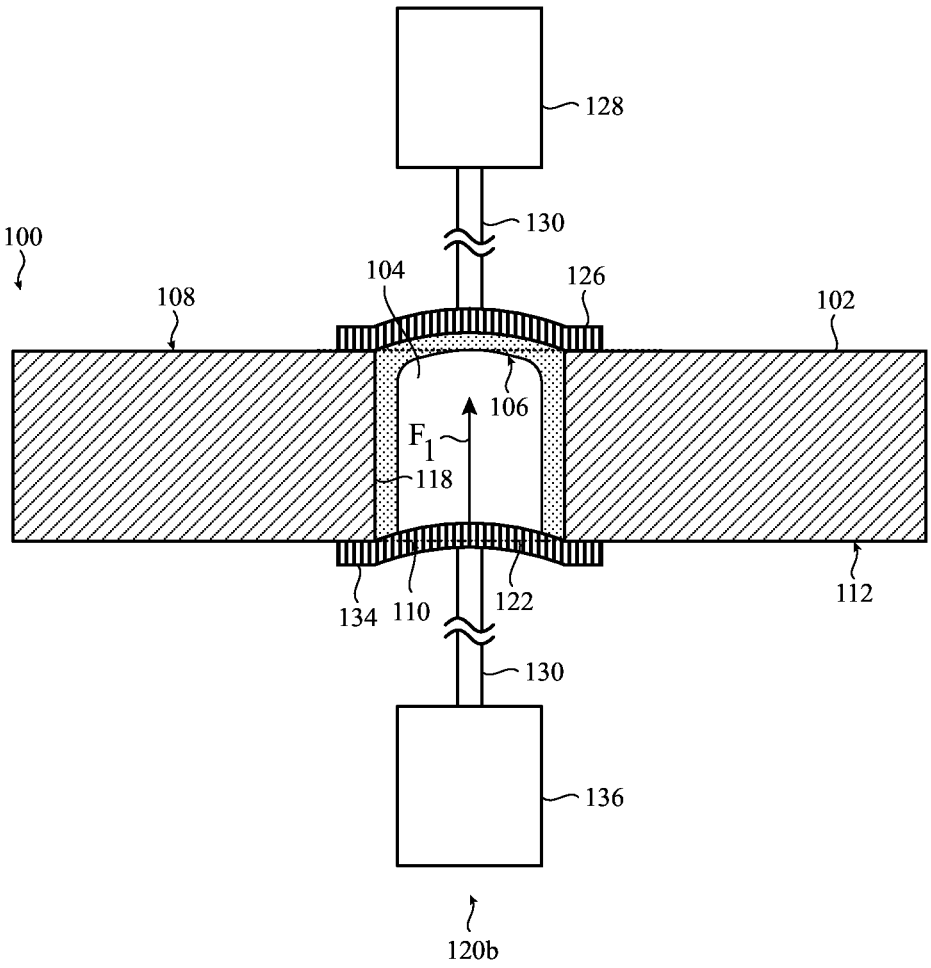
Figure 3C:
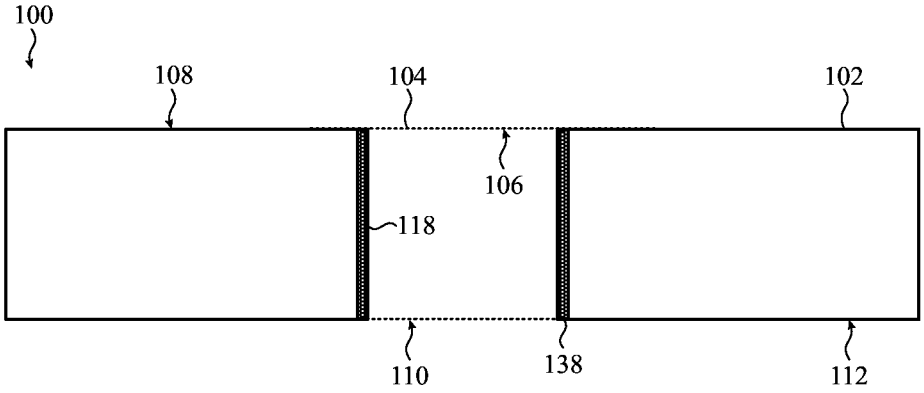
FIG. 3C depicts a cross-section view of the component of FIG. 1 including a polished channel.

FIGS. 3A-3C depict component 100 undergoing a polishing process using polishing system 120*a*, 120*b*. That is, FIGS. 3A-3C depict component surface 118 of channel 104 formed in component 100 undergoing a polishing process using polishing system 120*a*, 120*b*.

As shown in FIG. 3A, polishing system 120*a*, 120*b* may be coupled to and/or in fluid communication with channel 104 via first opening 106 and second opening 110, respectively, as discussed herein with respect to FIG. 2. Additionally, and as discussed herein with respect to FIG. 2, first flexible membrane 126 may form a seal around first opening 106 and second flexible membrane 134 may form a seal around second opening 110. As a result of the seal being formed at the respective openings in component 100, it is understood that channel 104, having abrasive slurry 122 positioned therein, may have an evenly distributed internal pressure in a static state or when there is no movement of the components of polishing system 120*a*, 120*b*.

However, as shown in FIG. 3A, polishing system 120*a*, 120*b* may actuate or deform first flexible membrane 126 and/or second flexible membrane 134 to vary the pressure within channel 104. First actuator 128 of polishing system 120*a* may actuate first flexible membrane 126 to move to a first actuator push position. As shown in FIG. 3A, the push position of first flexible membrane 126 may deform or move a portion of first flexible membrane 126 within channel 104, while maintaining first flexible membrane's 126 seal around first opening 106.

Simultaneously, or substantially simultaneously, to first actuator 128 actuating first flexible membrane 126 to move to a first actuator push position, second actuator 136 of polishing system 120*b* may actuate second flexible membrane 134 to move to a second actuator pull position. As shown in FIG. 3A, the pull position of second flexible membrane 134 may deform or move a portion of second flexible membrane 134 away from channel 104 and/or out of plane (shown in phantom) with bottom surface 112, while maintaining second flexible membrane's 134 seal around second opening 110.

By moving or actuating first flexible membrane 126 to a first actuator push position and moving second flexible membrane 134 to a second actuator pull position, the pressure within channel 104 may vary. In a non-limiting example shown in FIG. 3A, when first flexible membrane 126 is in the push position and second flexible membrane 134 is in the pull position, a first force (F1) or pressure flow may be applied within channel 104 toward second flexible membrane 134. Actuating first flexible membrane 126 to the push position may result in a pressure force being applied in a direction away from first flexible membrane 126. Additionally, actuating second flexible membrane 134 to the pull position may result in a pressure force or suction being applied in a direction toward second flexible membrane 134.

As a result of the actuation of first flexible membrane 126 and second flexible membrane 134 and the resulting first force (F1) or pressure flow, abrasive slurry 122 may be displaced within channel 104. As shown in FIG. 3A, as a result of the actuation of first flexible membrane 126 and second flexible membrane 134, the first force (F1) may change the pressure within channel 104 and may cause abrasive slurry 122 to be displaced throughout channel 104. When displaced throughout channel 104, abrasive slurry 122 may flow over surface 118 of channel 104 toward first flexible membrane 126 and/or opposite the direction of first force (F1). As abrasive slurry 122 flows over surface 118, abrasive slurry 122 may polish surface 118 of channel 104.

FIG. 3B shows polishing system 120*a*, 120*b* actuating or deforming first flexible membrane 126 and second flexible membrane 134 again to vary the pressure within channel 104. That is, component 100 and polishing system 120*a*, 120*b* undergo an additional actuation process to polish surface 118 of channel 104 after the actuation process as shown in FIG. 3A.

As shown in FIG. 3B, first actuator 128 of polishing system 120*a* may actuate first flexible membrane 126 to a first actuator pull position. Similar to the discussions herein with respect to second flexible membrane 134 in FIG. 3A, the first actuator pull position of first flexible membrane 126 may deform or move a portion of first flexible membrane 126 away from channel 104 and/or out of plane (shown in phantom) with top surface 108, while maintaining first flexible membrane's 126 seal around first opening 106.

Additionally, and simultaneously, or substantially simultaneously with actuating first flexible membrane 126 to a first actuator pull position, second actuator 136 may be actuated to a second actuator push position. As shown in FIG. 3B, and similarly discussed herein with respect to first flexible membrane 126 in FIG. 3A, the second actuator push position of second flexible membrane 134 may deform or move a portion of second flexible membrane 134 within channel 104, while maintaining second flexible membrane's 134 seal around second opening 110.

Similar to FIG. 3A, by moving or actuating first flexible membrane 126 to a first actuator pull position and moving second flexible membrane 134 to a second actuator push position, the pressure within channel 104 may vary again. In the non-limiting example shown in FIG. 3B, when first flexible membrane 126 is in the pull position and second flexible membrane 134 is in the push position, a second force (F2) or pressure flow may be applied within channel 104 toward first flexible membrane 126. Specifically, actuating second flexible membrane 134 to the push position may result in a pressure force being applied in a direction away from second flexible membrane 134. Additionally, actuating first flexible membrane 126 to the pull position may result in a pressure force or suction being applied in a direction toward first flexible membrane 126.

As a result of the actuation of first flexible membrane 126 and second flexible membrane 134 and the resulting second force (F2) or pressure flow, abrasive slurry 122 may be displaced within channel 104 again. As shown in FIG. 3B, as a result of the actuation of first flexible membrane 126 and second flexible membrane 134, the second force (F2) may change the pressure within channel 104 and may cause abrasive slurry 122 to be displaced throughout channel 104. Similar to FIG. 3A, when displaced throughout channel 104, abrasive slurry 122 may flow over surface 118 of channel 104. However, in the non-limiting example shown in FIG. 3B, abrasive slurry 122 may flow or move toward second flexible membrane 134 and/or opposite the direction of second force (F2). As abrasive slurry 122 flows over surface 118, as shown in FIG. 3B, abrasive slurry 122 may continue to polish surface 118 of channel 104.

By continuously or repeatedly actuating first flexible membrane 126 and second flexible membrane 134 between the pull position and the push position, respectively, surface 118 may be polished to a desired finish. Specifically, as first flexible membrane 126 and second flexible membrane 134 are actuated between the pull position and the push position and abrasive slurry 122 continuously moves throughout or within channel 104 and over surface 118, surface 118 may be polished.

As shown in FIG. 3C, surface 118 of channel 104 of component 100 may include a polished portion 138. Polished portion 138 of surface 118 of component 100 may be formed by actuating first flexible membrane 126 and second flexible membrane 134, respectively, a predetermined amount of times and/or for a predetermined amount of time based on the material forming component 100, the size of channel 104 and/or the desired polish to be formed on surface 118.

Although depicted in FIGS. 3A-3C as only partially filling channel 104, it is understood that abrasive slurry 122 may completely fill channel 104. As similarly discussed herein, polishing system 120*a*, 120*b* may be operational to agitate abrasive slurry 122 completely filling channel 104 to polish surface 118 of channel 104.

Figure 4:
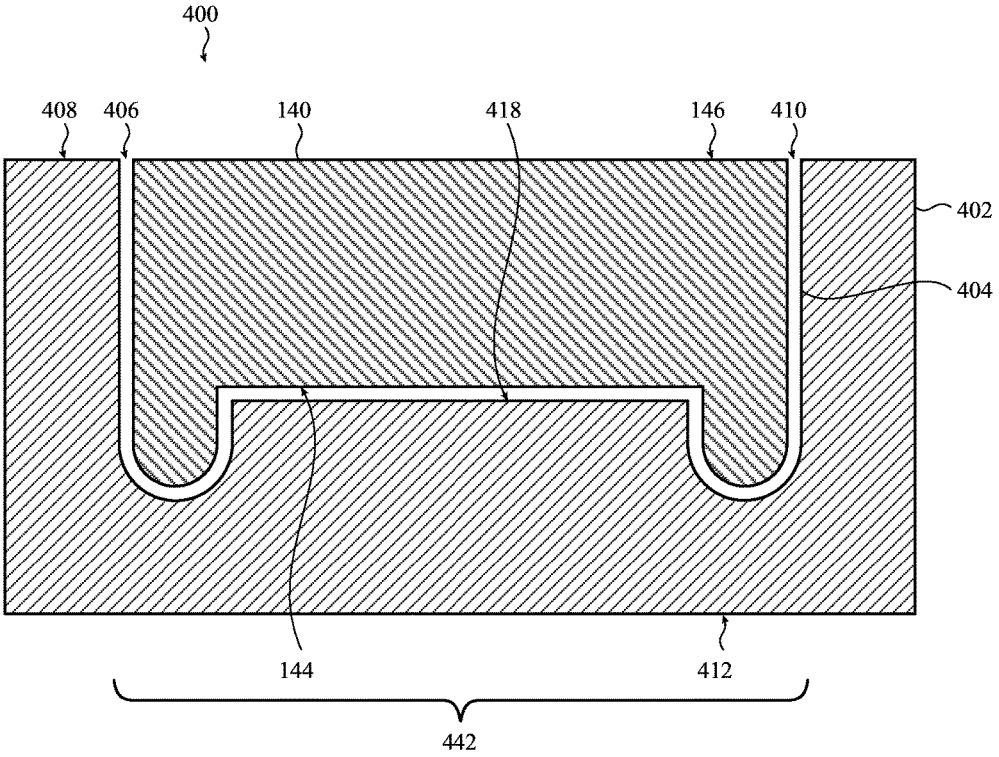
FIG. 4 depicts a cross-section of a component including a surface feature and a tooling element of a polishing system positioned within the recess.

FIG. 4 depicts a cross-section view of a component 400 and a tooling element 140 of polishing system 120*a*, 120*b*. Component 400 may be substantially similar to component 100 discussed herein with respect to FIGS. 1-3C. Component 400 may include a body portion 402, a top surface 408 and bottom surface 416. Distinct from component 100, component 400 may not include a channel formed completely through body portion 402. Rather, as shown in FIG. 4, channel 404 may be formed between a recess 442 formed partially through body portion 402 of component 400 and tooling element 140. Recess 442 formed partially through body portion 402 of component 400 may include surface 118 having a complex geometry including, but not limited to, one or more curved portions, angular portions and/or non-linear portions. Additionally, tooling element 140 may include an outer surface 144 having a complex geometry that may correspond to the complex geometry of surface 118. When tooling element 140 is positioned within recess 442 of component 400, channel 404 may be formed within and/or between component 400 and tooling element 140. Additionally, as shown in FIG. 4, when tooling element 140 is positioned within recess 442 of component 400 to form channel 404, exposed surface 146 of tooling element 140 may be aligned and/or planar with top surface 408 of component 400.

Tooling element 140 includes a temporary and/or disposable insert or fill component that is positioned within recess 442 to form channel 404 between component 400 and tooling element 140. In a non-limiting examples, and as discussed herein, tooling element 140 may be a substantially rigid insert and/or structure that may be suspended and/or positioned within recess 442 to create and/or form channel 404. Tooling element is also a distinct component from component 400, and is part of the polishing system used to polish channel 404, as discussed herein. Tooling element 140 may be formed from any material that may substantially maintain channel 404 during a polishing process of component 400. In a non-limiting example, tooling element 140 may be formed from a metal or metal alloy that may not substantially wear during the polishing process and/or may be cast to include a geometry corresponding to the geometry of surface 418 of component 400.

FIGS. 5A-5E depict component 400 undergoing a polishing process using polishing system 120*a*, 120*b*. As one example, FIGS. 5A-5E depict surface 418 of channel 404 formed in component 400 undergoing a polishing process using polishing system 120*a*, 120*b*. It is understood that similarly numbered components may function in a substantially similar fashion. Redundant explanation of these components has been omitted for clarity.

Figure 5A:
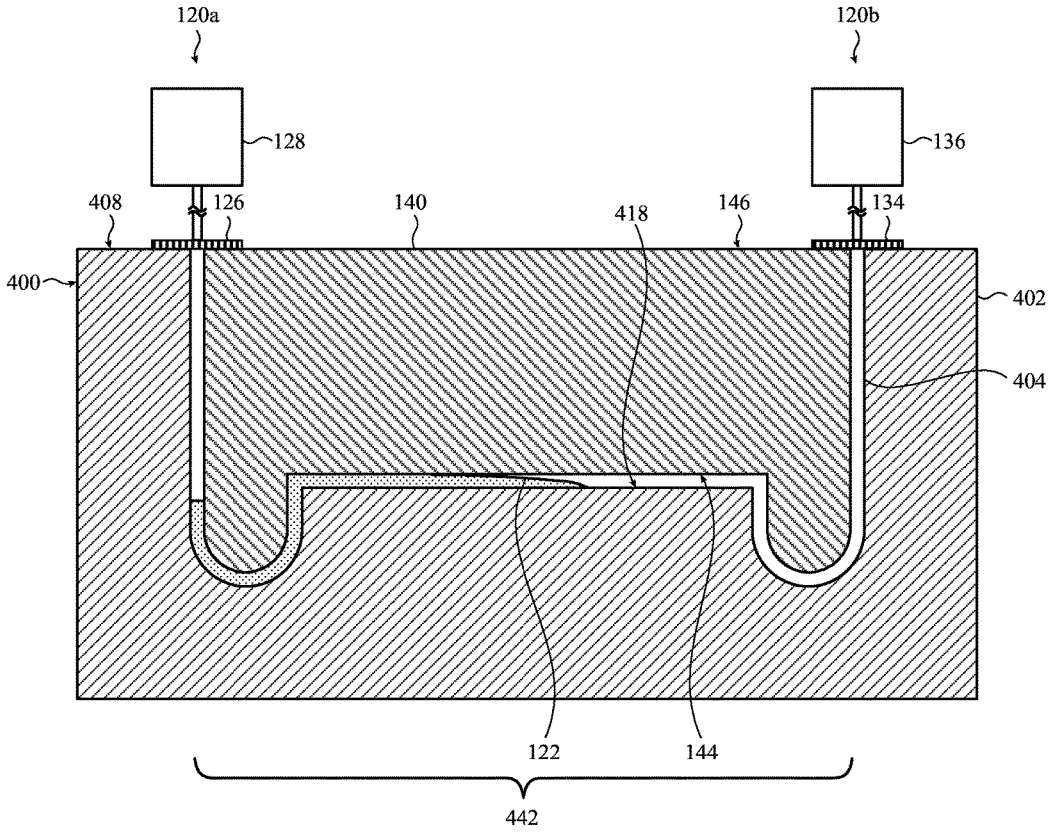
FIG. 5A depicts a cross-section view of the component of FIG. 4 and a polishing system.

FIG. 5A shows component 400 prior to performing the polishing process. As shown in FIG. 5A, polishing system 120*a*, 120*b* may be in fluid communication with channel 404 formed between body portion 402 and tooling element 140. As similarly discussed herein with respect to FIGS. 2-3B, first flexible membrane 126 of polishing system 120*a* may form a seal around first opening 406 of component 400 and second flexible membrane 134 of polishing system 120*b* may form a seal around second opening 410. However, distinct from FIGS. 2-3B, first flexible membrane 126 and second flexible membrane 134 may be coupled to the same surface.

As one example, and as shown in FIG. 5A, first opening 406 and second opening 410 of channel 404 may be formed through top surface 408 of component 400. As such, both first flexible membrane 126 and second flexible membrane 134 may be coupled to a portion of top surface 408 of component and exposed surface of tooling element 140 for forming seals around the respective openings of channel 404.

Abrasive slurry 122 may be positioned within channel 404 of component 400. As shown in FIG. 5A, abrasive slurry 122 may be positioned within a portion of channel 404 of component 400 and may contact surface 418 of recess 442 of component 400, as well as outer surface 144 of tooling element 140. As discussed herein, abrasive slurry 122 may flow through channel 404, contacting surface 418 of component, to form a polished portion 438 of component 400 (see, FIG. 5E).

Figure 5B:
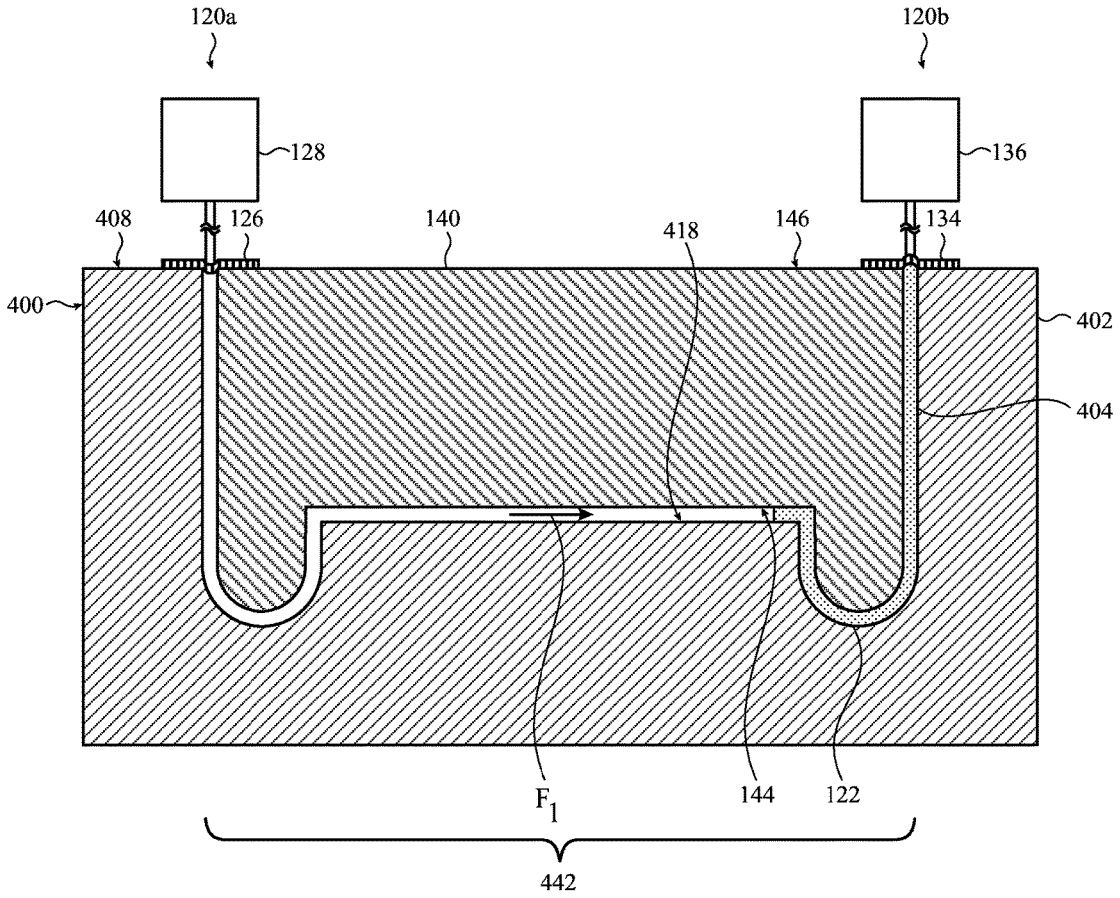
FIGS. 5B-5D depict cross-section views of the component of FIG. 4 undergoing a polishing process performed by the polishing system.

FIG. 5B depicts polishing system 120*a*, 120*b* actuating first flexible membrane 126 and second flexible membrane 134 to apply a first force (F1) or pressure flow to channel 404, toward second flexible membrane 134. As shown in FIG. 5B, and as similarly discussed herein with respect to FIG. 3A, first flexible membrane 126 may be actuated to a push position and second flexible membrane 134 may be actuated to a pull position to apply a first force (F1) through channel 404. As a result of first force (F1) being applied through channel 404 of component 400, abrasive slurry 122 may be displaced or move through channel 404, toward second opening 410 and/or second flexible membrane 134. As discussed herein, abrasive slurry 122 may contact and/or polish surface 418 of channel 404 as abrasive slurry 122 moves through channel 404.

Figure 5C:
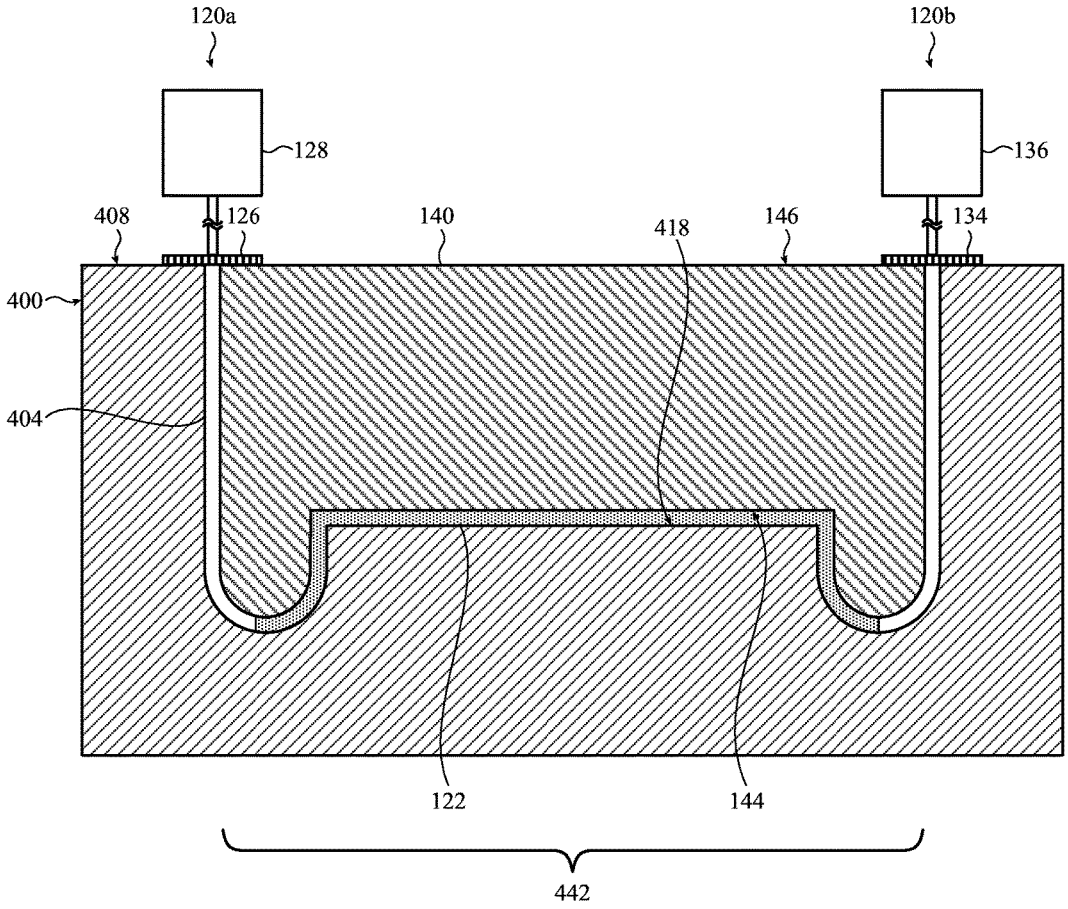

FIG. 5C depicts polishing system 120*a*, 120*b* actuating first flexible membrane 126 and second flexible membrane 134 to a neutral position. As shown in FIG. 5C, first flexible membrane 126 may be actuated out of the push position and second flexible membrane 134 may be actuated out of the pull position and both flexible membranes 126, 134 may be in a neutral position. When in a neutral position, no force may be applied through channel 404. As a result, the pressure within channel 404 of component 400 may return back to a static state and abrasive slurry 122 may settle at the bottom of recess 442 and/or channel 404 of component 400.

Figure 5D:
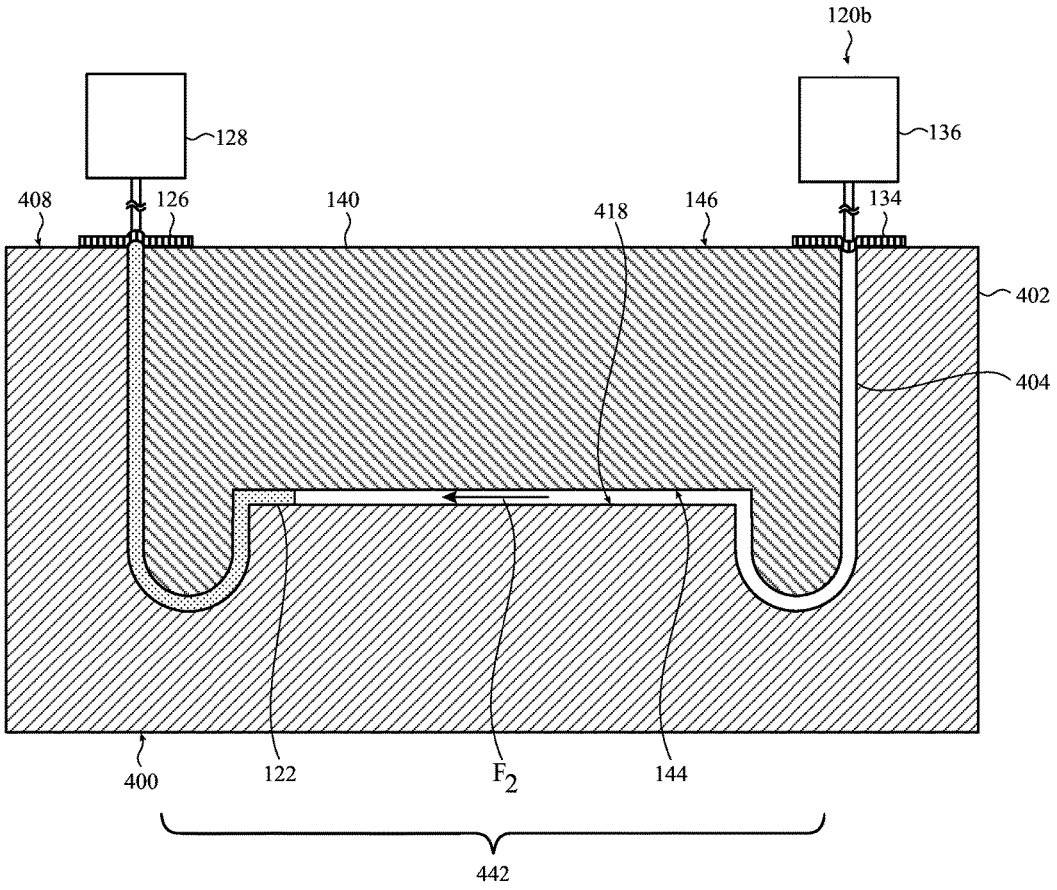

FIG. 5D depicts polishing system 120*a*, 120*b* actuating first flexible membrane 126 and second flexible membrane 134 to apply a second force (F2) or pressure flow to channel 404, toward first flexible membrane 126. As shown in FIG. 5B, and as discussed herein with respect to FIG. 3B, first flexible membrane 126 may be actuated to the pull position and second flexible membrane 134 may be actuated to the push position to apply a second force (F2) through channel 404. As a result of second force (F2) being applied through channel 404 of component 400, abrasive slurry 122 may be displaced or move through channel 404, toward first opening 406 and/or first flexible membrane 126. As discussed herein, abrasive slurry 122 may contact and/or continue to polish surface 418 of channel 404 as abrasive slurry moves through channel 404, as shown in FIG. 5D.

Figure 5E:
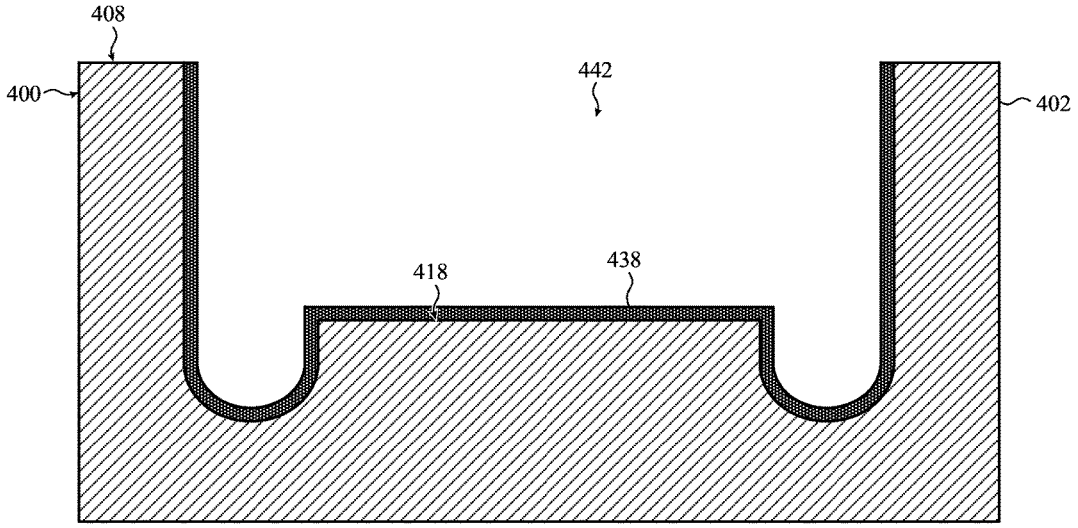
FIG. 5E depicts a cross-section view of the component of FIG. 4 including a polished channel.

Similar to FIGS. 3A-3C, abrasive slurry 122 may continuously move within channel 404, between first opening 406 and second opening 410, by repeatedly actuating first flexible membrane 126 and second flexible membrane 134 between a push position and a pull position. As shown in FIG. 5E, surface 418 of component 400 may have polished portion 438 after continuous actuation of the respective flexible membranes and/or the continuous movement of abrasive slurry 122 over surface 418. Once polished portion 438 is formed on surface 418, tooling element 140 may be removed from recess 442, and component 400, having polished portion 438, may be ready for implementation within a device or system, as desired.

Although discussed herein with respect to FIGS. 3A-3C and 5A-5E as performing a polishing process using polishing system 120*a*, 120*b* on a single component (e.g., component 100, component 400), it is understood that multiple components may be polished simultaneously by polishing system 120*a*, 120*b*. Multiple components may be positioned adjacent one another (e.g., stacked, contacting, aligned) to polish multiple components in a single polishing process. Where applicable, tooling element 140 may also be configured or shaped to form a channel within multiple components (e.g., 400), and provide only two openings for polishing system 120*a*, 120*b*. As a result, abrasive slurry 122 may be moved between multiple components for polishing a surface (e.g., surface 118, 418) of channel 104, 404.

Additionally, although tooling element 140 is discussed as only polishing a single component (e.g., component 100, component 400), it is understood that tooling element 140 may be utilized to polish multiple components in succession. In a non-limiting example, tooling element 140 may be used to polish multiple components individually using polishing system 120*a*, 120*b*, where the tooling element 140 is placed in each component prior to performing the polishing process, as discussed herein.

Figure 6:
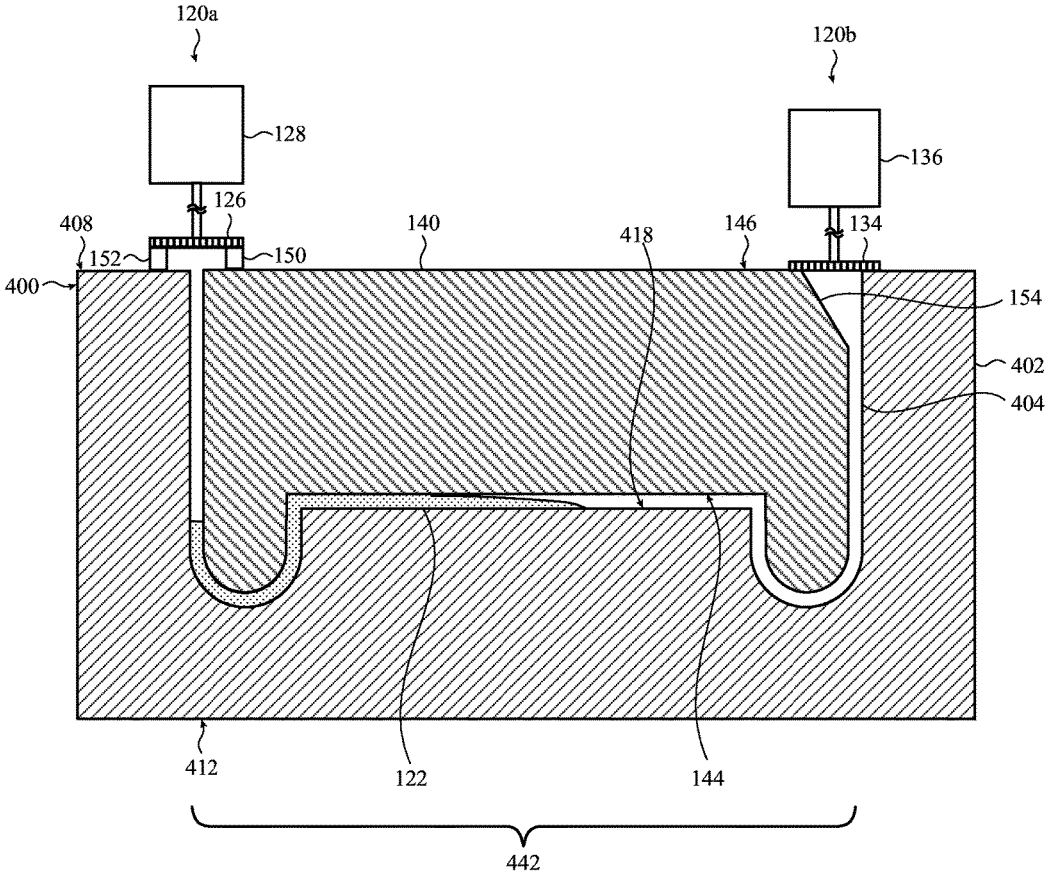
FIG. 6 depicts a cross-section view of the component of FIG. 4 and a polishing system including a gasket and a cutout tooling element.

FIG. 6 depicts a cross-section view of component 400 and polishing system 120*a*, 120*b* according to another non-limiting embodiment. As shown in FIG. 6, the space surrounding first opening 406 and second opening 410 may be increased to allow for a greater pressure force and/or suction force to be applied to channel 404 of component 400 during a polishing process performed by polishing system 120*a*, 120*b*. That is, by increasing the area of first opening 406 and/or second opening 410 of channel 404, first flexible membrane 126 and/or second flexible membrane 134 may be actuated, moved or displaced a greater distance, which may increase the pressure force and/or suction force applied to channel 404.

In an non-limiting example, as shown in FIG. 6, polishing system 120*a* may utilize a gasket 150 coupled to first flexible membrane 126. Gasket 150 may be coupled to top surface 408 of component 400 and exposed surface 146 of tooling element 140 to form a seal around first opening 406. Additionally, as shown in FIG. 6, gasket 150 may raise first flexible membrane 126 substantially above first opening 406, and more specifically, may form a space 152 between first opening 406 and first flexible membrane 126. Gasket 150 may allow first flexible membrane 126 to be actuated or displaced within space 152. By actuating first flexible membrane 126 in space 152 formed by gasket 150, a larger portion of first flexible membrane 126 may be actuated into space 152 when compared to first flexible membrane 126 being actuated directly into channel 404 (see, FIG. 5B). By increasing the portion of first flexible membrane 126 that is actuated, as well as, increasing the depth within space 152 that first flexible membrane 126 may be actuated, the force or pressure flow applied through channel 404 may also be increased.

In another non-limiting example, an opening of channel 404 may be increased by providing a cutout 154 in tooling element 140. As shown in FIG. 6, the size of second opening 410 of channel 404 may be increased by providing cutout 154 in tooling element 140, adjacent second opening 410. Similar to space 152 formed by gasket 150, cutout 154 of tooling element 140 may allow second flexible membrane 134 to be actuated or displaced a greater distance into channel 404 of component during a polishing process. By increasing the distance in which second flexible membrane 134 may be actuated or displaced, a force or pressure flow applied to channel 404 by second flexible membrane 134 may also be increased.

Although shown in FIG. 6 to include distinct features for increasing actuation or displacement for each of the flexible membranes, it is understood that any combination of the features of FIG. 6 may be used by polishing system 120*a*, 120*b*. In a non-limiting example, both first flexible membrane 126 and second flexible membrane 134 may utilize gaskets 150, or tooling element 140 may have cutouts 154 adjacent to first opening 406 and second opening 410. Additionally, in another non-limiting example, both gaskets 150 and cutouts 154 on tooling element 140 may be used with polishing system 120*a*, 120*b*.

Figure 7:
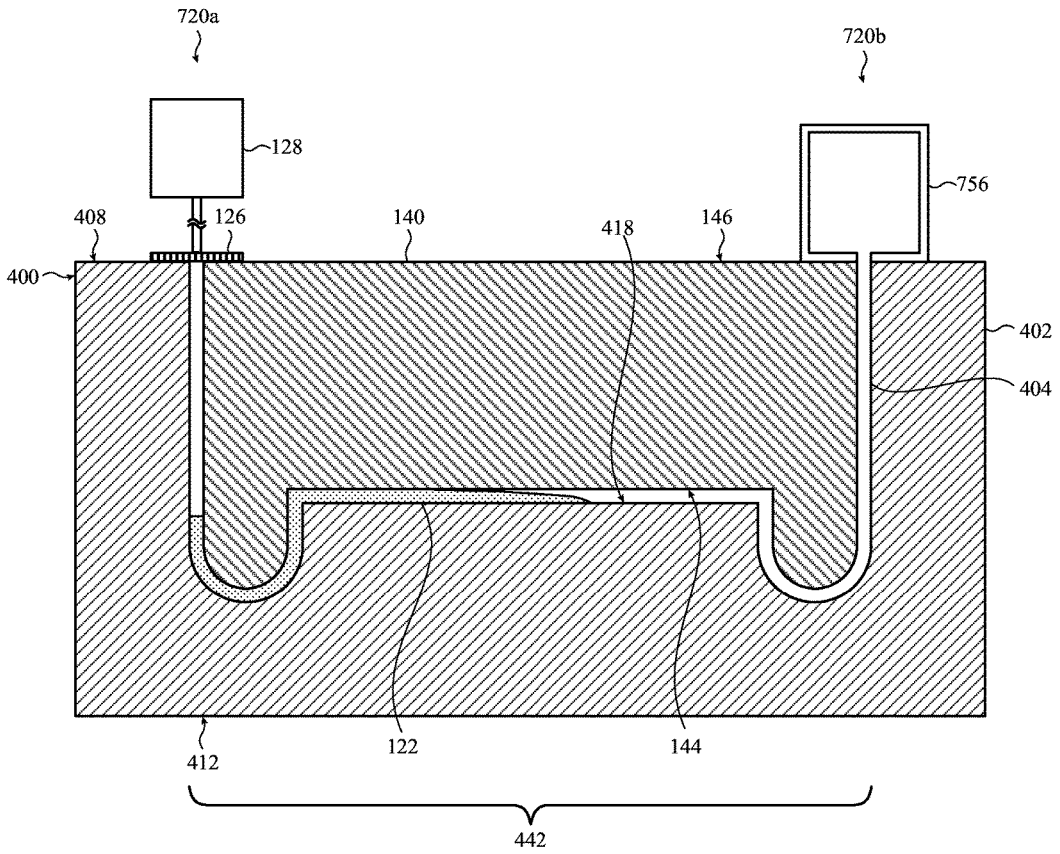
FIG. 7 depicts a cross-section view of the component of FIG. 4 and a polishing system including an actuator and a reservoir.

FIG. 7 depicts a cross-section view of component 400 and a distinct polishing system 720*a*, 720*b* according to other non-limiting embodiments. Distinct from polishing system 120*b* discussed herein with respect to FIGS. 5B and 5C, polishing system 720*b* may not include a second flexible membrane or a second actuator. Rather, as shown in FIG. 7, polishing system 720*b* may include a reservoir 756 forming a seal around second opening 410 of channel 404. Reservoir 756 may maintain the air tight seal around channel 404. Reservoir 756 may receive air and/or abrasive slurry 122 during the polishing process performed on channel 404 of component 400. As first flexible membrane 126 is actuated to a push position, and a push force is applied to channel 404, reservoir 756 may receive at least a portion of the forced air applied to channel 404 and/or a portion of abrasive slurry 122 flowing through channel 404 toward second opening 410. In addition, when first flexible membrane 126 is actuated to a pull position, the suction force applied to channel 404 by first flexible membrane 126 may be applied to reservoir 756 as well. As a result, abrasive slurry 122 positioned within reservoir 756 may flow from reservoir 756 toward first flexible membrane 126.

Figure 8:
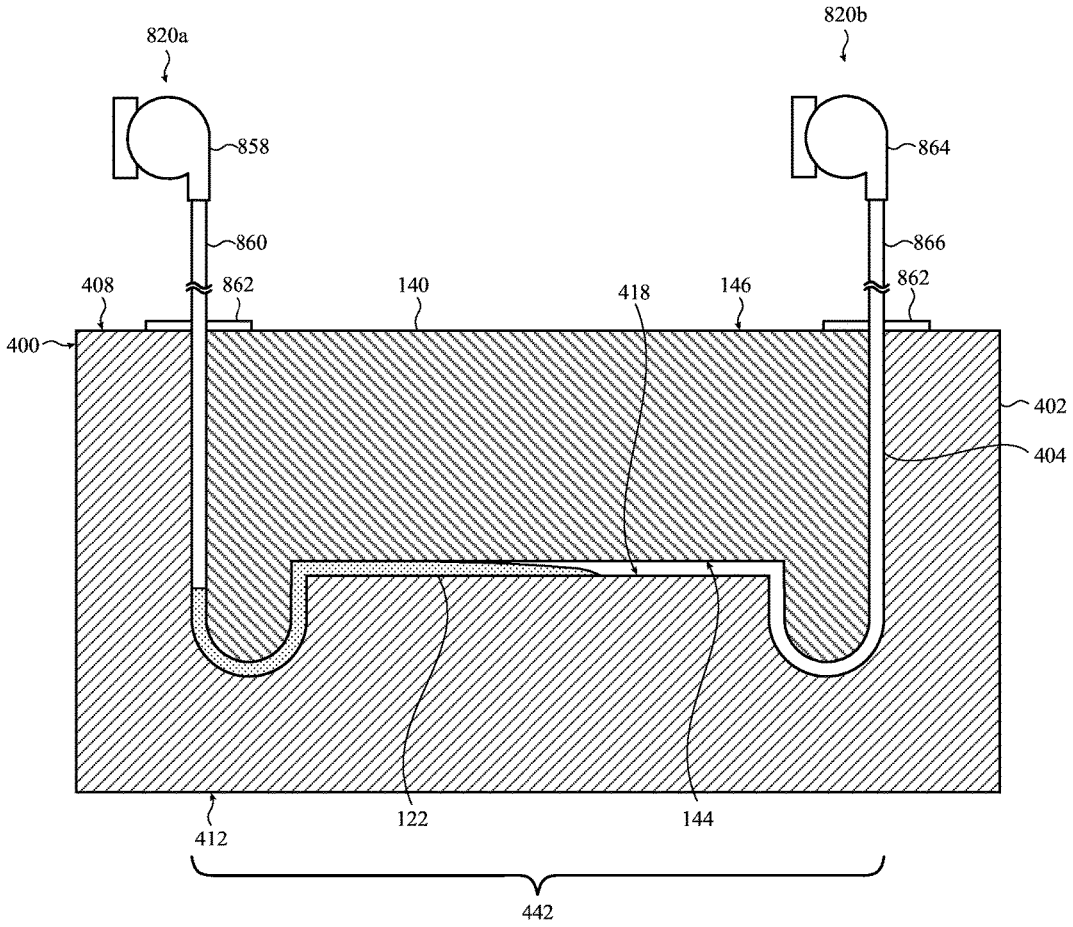
FIG. 8 depicts a cross-section view of the component of FIG. 4 and a polishing system including two fluid pumps.

FIG. 8 depicts a cross-section view of component 400 and an additional polishing system 820*a*, 820*b* according to distinct, non-limiting embodiments. As shown in FIG. 8, polishing system 820*a*, 820*b* may not include actuators or flexible membranes. Rather, polishing system 820*a* may include a first pump 858 in fluid communication with first opening 406 of channel 404. First pump 858 may be in fluid communication with first opening 406 via a first hose or conduit 860. As shown in FIG. 8, first conduit 860 may be directly coupled to first pump 858 and first opening 406 of channel 404. Additionally, as shown in FIG. 8, first conduit 860 may form a seal with first opening 406 to prevent leakage of air pressure or force provided by first pump 858 during a polishing process. To aid in the formation of the seal with first opening 406, an O-ring 862 may be coupled to first conduit 860, and may also be coupled to a portion of top surface 408 of component 400 and exposed surface 146 of tooling element 140, to surround first opening 406. First pump 858 may be any suitable air pump that may provide a pressure force to channel 404 via first conduit 860 during a polishing process, as discussed herein.

Also shown in FIG. 8, polishing system 820*b* may include similar components as polishing system 820*a*. That is, polishing system 820*b* may include a second pump 864 in fluid communication with second opening 410 of channel 404 via second hose or conduit 866. Second conduit 866 may form a seal with second opening 410 of channel 404 and may utilize O-ring 862 to aid in forming the seal.

When performing a polishing process using polishing system 820*a*, 820*b*, abrasive slurry 122 positioned within channel 404 may be moved between first opening 406 and second opening 410 using first pump 858 and second pump 864. That is, first pump 858 and second pump 864 of polishing system 820*a*, 820*b* may alternate providing a force or pressure flow through channel 404 to move or flow abrasive slurry 122 through channel 404 to contact and subsequently polish surface 418. In a non-limiting example, first pump 858 may be operable to provide a push force through channel 404 to move abrasive slurry 122 through channel 404 toward second opening 410. Simultaneously, second pump 864 may be inoperable to provide no pressure flow to channel 404 or may be throttled to provide an minimal pressure flow to channel 404 that may be overcome or negligible when push force is applied to channel 404 by first pump 858. Once abrasive slurry 122 reaches second opening 410, the respective pumps of polishing system 820*a*, 820*b* may switch operational states. That is, second pump 864 may provide a push force through channel 404 to move abrasive slurry 122 through channel 404 toward first opening 406 and first pump 858 may be inoperable or throttled to allow push force of second pump 864 to move or flow abrasive slurry toward first opening 406. As similarly discussed herein, first pump 858 and second pump 864 may repeatedly alternate operational states to continuously move or flow abrasive slurry 122 through channel 404, and over surface 418, to ultimately form polished portion (see, FIG. 5E) on surface 418 of channel 404.

Figure 9:
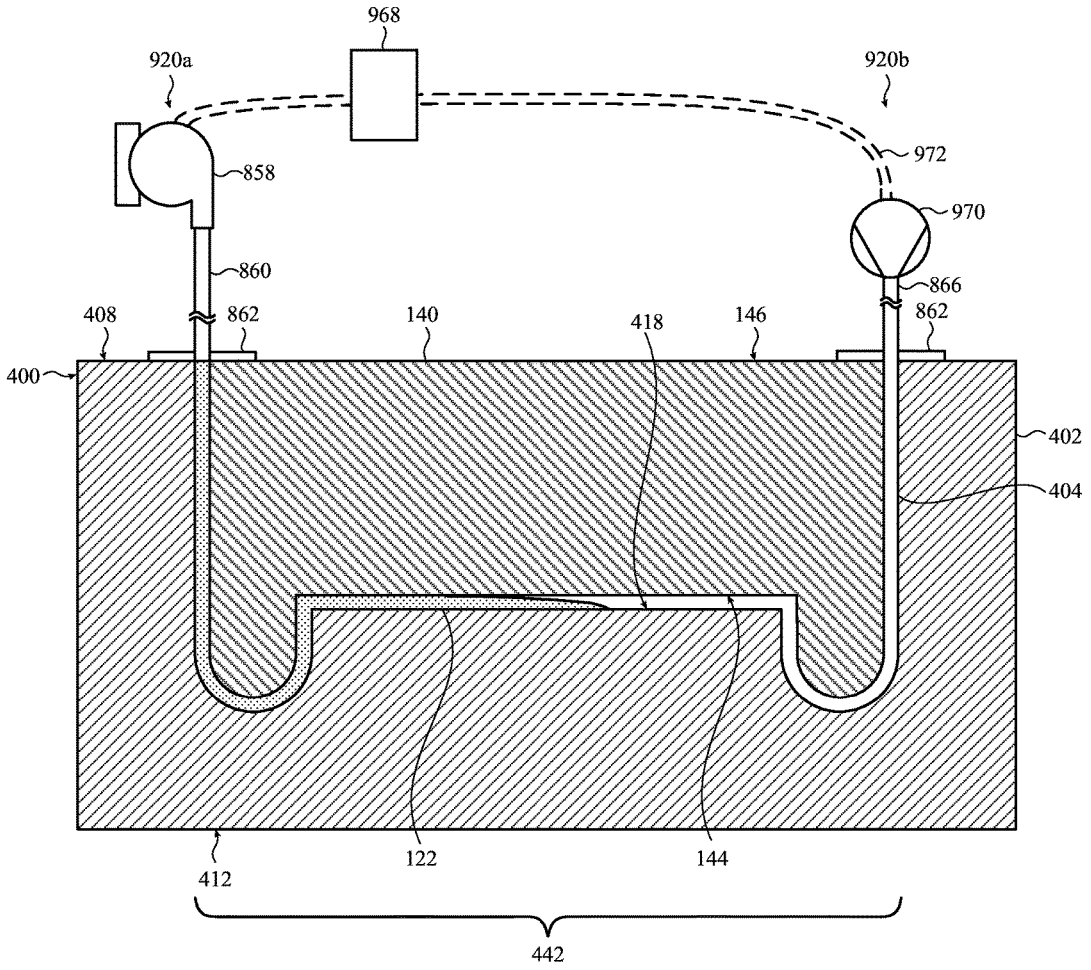
FIG. 9 depicts a cross-section view of the component of FIG. 4 and a polishing system including a fluid pump and a vacuum chamber.

FIG. 9 depicts a cross-section view of component 400 and an additional polishing system 920*a*, 920*b* according to distinct, non-limiting embodiments. Distinct from polishing system 820*a* discussed herein with respect to FIG. 8, first pump 858 of polishing system 920*a* may provide a continuous flow of abrasive slurry 122 through channel 404 during a polishing process. First pump 858 may be in fluid communication with a supply tank 968 of abrasive slurry 122. During a polishing process, first pump 858 may supply a continuous flow of abrasive slurry 122 from supply tank 968 to channel 404 through first opening 406. The continuous flow of abrasive slurry 122 supplied by first pump 858 may flow completely through channel 404, contacting and polishing surface 418, and may leave channel 404 via second opening 410.

Also distinct from polishing system 820*b* discussed herein with respect to FIG. 8, polishing system 920*b* may not include second pump 864 coupled to second conduit 866. Rather, as shown in FIG. 9, polishing system 920*b* may include a vacuum chamber 970 in fluid communication with second opening 410 of channel 404. Vacuum chamber 970 may be in fluid communication with second opening via second conduit 866, which may form a seal with second opening 410, as discussed herein. Vacuum chamber 970 may provide a suction force within channel 404 of component 400 during a polishing process performed by polishing system 920*a*, 920*b*. In a non-limiting example, as first pump 858 of polishing system 820*a* supplies a continuous flow of abrasive slurry 122 through channel 404, vacuum chamber 970 may provide a suction force within channel 404 to aid in drawing abrasive slurry 122 through channel 404 and second opening 410. As shown in FIG. 9, an optional slurry recycling conduit 972, shown in phantom, may fluidly couple vacuum chamber 970 and supply tank 968. During the polishing process, the abrasive slurry 122 removed from channel 404 by vacuum chamber 970 may flow through slurry recycling conduit 972 to supply tank 968, to be reused or resupplied to channel 404 by first pump 858. The utilization of slurry recycling conduit 972 may form a closed loop polishing process where a finite amount of abrasive slurry 122 may be continuously used to form polished portion on surface 418 of component 400.

Although discussed herein as a channel or recess, it is understood that the feature of the component may include distinct and unique geometries as well. In a non-limiting example not shown, the component may include a protrusion that may require polishing. A surface of the protrusion of the component may be polished using similar devices (e.g., tooling element, first member, second member and the like) and similar processes (e.g., tooling element having corresponding geometry, flowing abrasive slurry and so on) discussed herein.

Figure 10:
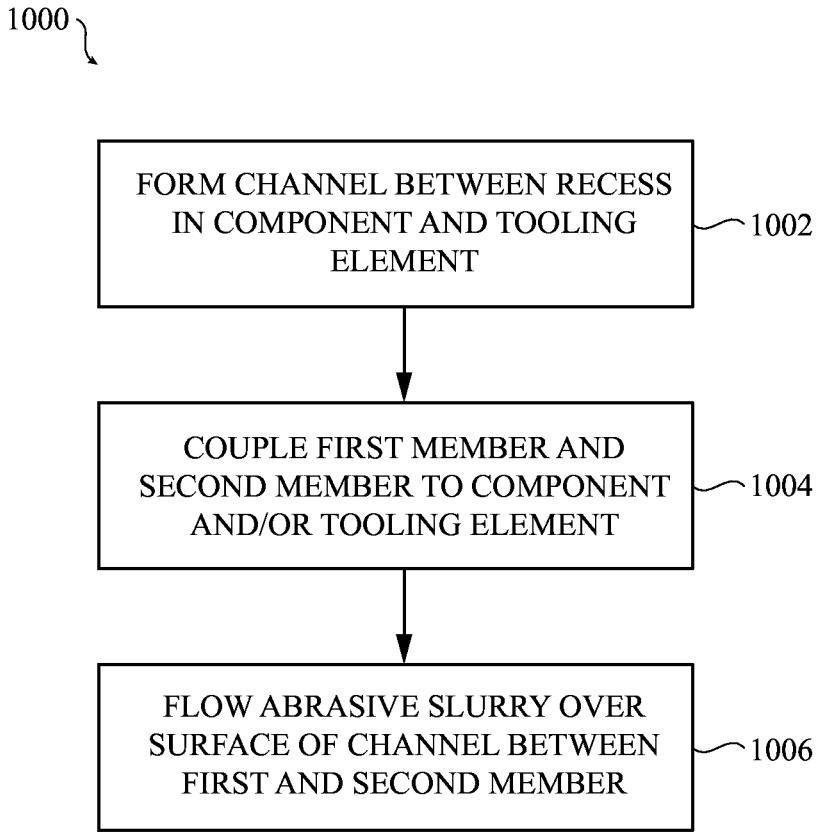
FIG. 10 depicts a flow chart illustrating a method for polishing a surface of a channel formed in a component.

Turning to FIG. 10, a method for polishing a surface of a channel formed in a component (see, FIG. 1) is now discussed. Specifically, FIG. 10 is a flowchart depicting one sample method 1000 for polishing a surface of a channel, as discussed herein with respect to FIGS. 1-9.

In operation 1002, a channel may be formed between a recess formed partially though a component and a tooling element positioned within the recess of the component. The tooling element may have an outer surface having a geometry that may correspond to a geometry of the recess formed in the component.

In operation 1004, a first member and a second member of a polishing system may be coupled to at least one of the component and the tooling element. The coupling of the first member and the second member to the component and/or the tooling element may enable fluid communication with the channel formed between the component and the tooling element. The coupling of the first member may also include forming a seal around a first opening of the channel formed between the recess and the tooling element. The seal formed around the first opening of the channel may prevent air from escaping from the channel. Additionally, the coupling of the second member may include forming a seal around a second opening of the channel formed between the recess and the tooling element. The second opening may be in fluid communication with the first opening. The seal formed around the second opening of the channel may prevent air from escaping from the channel, similar to the first member and first channel.

In operation 1006, an abrasive slurry may be flowed over the surface of the channel between the first member and the second member of the polishing system. That is, an abrasive slurry, formed from a diamond encrusted resin-based material, may flow over the surface of the channel to polish the surface of the channel. The flowing of the abrasive slurry over the surface of the channel may also include passing the abrasive slurry over the surface of the channel having a complex geometry. The complex geometry of the channel may be a curved, angular and/or non-linear, among other options.

The flowing of the abrasive slurry over the surface of the channel may be performed in a variety of processes dependent, at least in part, upon the configuration of the first member and the second member of the polishing system. In a non-limiting example the flowing of the abrasive slurry may include continuously varying a pressure within the channel using the first member and/or the second member of the polishing system. By continuously varying the pressure within the channel, the abrasive slurry may repeatedly move from the first opening to the second opening, and back, from the second opening to the first opening.

The flowing of the abrasive slurry may also include supplying a continuous flow of the abrasive slurry to the channel using the first member. That is, the first member of the polishing system may supply a continuous flow of the abrasive slurry to the surface of the channel. Additionally, in the non-limiting example, the second member may vacuum the continuous flow of the abrasive slurry supplied by the first member. That is, the second member may provide a vacuum force through the channel and to the abrasive slurry to move the supplied abrasive slurry through the channel from the first opening to the second opening. As the abrasive slurry moves through the channel of the component, the surface of the channel may be polished.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A method for polishing a component for a portable electronic device, the component having a non-linear surface, comprising:

forming a channel having a first opening and a second opening between the non-linear surface of the component and a corresponding non-linear surface of a tooling element, wherein slurry is capable of moving within the channel; and polishing the non-linear surface of the component by:

(i) pushing the slurry from the first opening towards the second opening by using a first flexible member, the first flexible member covering the first opening, and (ii) concurrent with pushing the slurry from the first opening towards the second opening, pulling the slurry towards the second opening by using a second flexible member, the second flexible member covering the second opening, wherein the non-linear surface is polished by movement of an amount of the slurry that is in polishing contact therewith.

2. The method of claim 1, wherein polishing the non-linear surface of the component further comprises:

(iii) pushing the slurry from the second opening towards the first opening by using the second flexible member, and (iv) concurrent with pushing the slurry from the second opening towards the first opening, pulling the slurry towards the first opening by using the first flexible member.

3. The method of claim 2, further comprising:

repeating (i)-(iv) until the non-linear surface of the component is polished according to a predetermined amount.

4. The method of claim 3, wherein moving the slurry within the channel comprises:

continuously varying a pressure within the channel using at least one of the first flexible member or the second flexible member; and repeatedly moving the slurry from:

the first opening to the second opening; and the second opening to the first opening.

5. The method of claim 1, wherein the first flexible member is coupled to an outer surface of the tooling element and a surface of the component, and the second flexible member is coupled to the outer surface of the tooling element and the surface of the component.

6. The method of claim 5, wherein the component includes a recess that is formed partially through the component, and the recess includes a geometry that corresponds to the non-linear surface of the component and the corresponding non-linear surface of the tooling element.

7. The method of claim 5, wherein a portion of the outer surface of the tooling element is substantially planar to a portion of the surface of the component.

* * * * *